US008325779B2

(12) United States Patent
MacRae

(10) Patent No.: US 8,325,779 B2
(45) Date of Patent: Dec. 4, 2012

(54) WIDE-RANGE ROUND-BOTTOM HEARTH-BRICK COMPRESSION SYSTEM

(76) Inventor: Allan J. MacRae, Hayward, CA (US)

( * ) Notice: Subject to any disclaimer, the term of this patent is extended or adjusted under 35 U.S.C. 154(b) by 427 days.

(21) Appl. No.: 12/700,721

(22) Filed: Feb. 5, 2010

(65) Prior Publication Data

US 2010/0132599 A1 Jun. 3, 2010

Related U.S. Application Data

(60) Division of application No. 11/674,123, filed on Feb. 12, 2007, and a continuation-in-part of application No. 11/674,123, filed on Feb. 12, 2007.

(51) Int. Cl.
*F23M 5/04* (2006.01)
*F23M 5/00* (2006.01)

(52) U.S. Cl. ..... 373/72; 219/385; 110/338; 110/340; 110/336; 266/286; 266/285

(58) Field of Classification Search ..... 219/385; 110/338, 340, 336; 266/286, 285
See application file for complete search history.

(56) References Cited

U.S. PATENT DOCUMENTS 3,175,961 A 3/1965 Olsen
3,399,267 A 8/1968 Renkey et al.
4,773,630 A * 9/1988 Carminati et al. ..... 266/285
4,923,397 A 5/1990 Nassett
5,648,981 A 7/1997 Miner et al.
5,867,523 A 2/1999 Wasmund et al.
6,814,012 B2 11/2004 McCaffrey et al.
6,911,176 B2 6/2005 Saarinen
2006/0196399 A1 * 9/2006 McCaffrey et al. ..... 110/336

OTHER PUBLICATIONS

T. Ma, et al., Recent Developments in DC Furnace Design, symposium paper presented in Montreal, Candada, Aug. 1999.

* cited by examiner

*Primary Examiner* — Tom Thomas
*Assistant Examiner* — Benjamin Tzu-Hung Liu
(74) *Attorney, Agent, or Firm* — Main Law Firm; Richard B. Main

(57) ABSTRACT

A brick hearth system comprises a rigid containment shell in which a concave bottom is lined with a hearth refractory sub-layer and hearth brick working layer. The outer perimeter of the hearth refractory is ringed with thrust blocks to compress the whole toward the center and to thereby deny gaps from forming between the separate bricks. Many individual thrust rods penetrate the outer bottom of the containment shell, and such are used to transmit compression forces generated outside the shell to be applied against the thrust blocks in unison. Each thrust rod receives an adjustable amount of inward force from a spring, acting either directly or through a beam or rocker arm. These are anchored to and use the hoop strength of the containment shell as leverage. As the hearth brick working layer grows during its service life, the ring of thrust blocks grows in diameter as well inside the margins provided within the containment shell. The individual thrust rod springs are periodically adjusted to keep the pressures in the optimal range.

9 Claims, 8 Drawing Sheets

WIDE-RANGE ROUND-BOTTOM HEARTH-BRICK COMPRESSION SYSTEM

COPENDING APPLICATIONS

This Application is a Divisional and Continuation-In-Part of U.S. patent application Ser. No. 11/674,123, filed Feb. 12, 2007, and titled, FURNACE HEARTH COMPRESSION, by the Present Inventor, Allan J. MacRae.

BACKGROUND

1. Field of the Invention

The present invention relates to round-bottom pyrometallergical furnaces with cylindrical containment shells for the smelting, converting, or melting of concentrates, mattes, or metals, and more particularly to methods and devices for applying and maintaining proper compression of the brick hearth in a furnace refractory so as to extend its service life.

2. Description of the Prior Art

One type of smelting furnace for winning iron from ore is built with vertical, cylindrical, steel containment shells with layers of refractory bricks inside the walls and a downwardly dished bottom. A hearth brick sub-layer on the bottom is covered with a brick hearth working layer. The refractory brick layers inside the steel containment shells can withstand the very high operating temperatures usual to the smelting of iron ore, and the outer shell provides the necessary containment and support.

Hearth bricks swell up in size over their operational lives as the bricks slowly absorb molecules of metal. Many expensive and complex ways have been devised over the years to keep the refractory bricks tightly pressed together as they swell so that liquid metal, matte, or slag cannot leak through the gaps. For example, so-called "flexible shells" bind adjoining overlapping plates together. The loose plate construction can allow for quite a lot of expansion and contraction. However, the cost of these kinds of containment shells is prohibitive.

Rigid hearth containment shells are much less expensive since they are constructed as a single rigid piece that does not require plate binding mechanisms. But conventional ways of keeping the hearth bricks together under the right pressures for these rigid shells accommodates only very limited growth in the hearth brick before shutdown and replacement with new brick is required.

Conventional systems are normally designed to accommodate the thermal expansion of the bricks, but do not maintain the pressure when the bricks cool down and shrink. This allows gaps to form which can invite molten materials to penetrate the brick joints. When the furnace finally reheats, the hearth is incrementally increased in diameter by the new material frozen in the joints. It therefore follows that extending the service life of the hearth bricks translates directly into big savings in the maintenance costs because fewer, less frequent shutdowns and brick replacements are needed over the life of the furnace.

What is needed are methods and devices that can maintain the pressures on the hearth bricks as the system cools down and the bricks shrink, and that can accommodate larger amounts of growth in the brick hearth over the campaign life, and that use the less expensive rigid shells to contain them.

SUMMARY OF THE INVENTION

Briefly, a brick hearth system embodiment of the present invention comprises a rigid containment shell in which a concave dished bottom is lined with a sub-layer and a working layer of hearth bricks. The outer perimeter of the hearth brick is ringed with thrust blocks to compress the whole radially toward the center and to thereby deny leaks from forming between the separate bricks. Many individual thrust rods penetrate the outer bottom of the containment shell, and such are used to transmit compression forces generated outside the shell to be applied inside against the thrust blocks in unison. Each thrust rod receives an adjustable amount of inward force from a spring, acting either directly or through a beam or rocker arm. These are anchored to and use the hoop strength of the containment shell as leverage. As the hearth bricks grow during their service life, the ring of thrust blocks grows too in diameter inside the margins provided within the containment shell. The individual thrust rod springs are periodically adjusted to keep the working pressures in an optimal range.

An advantage of the present invention is that replacement of the furnace hearth and the surrounding expansion material is less frequent compared to conventional systems.

A still further advantage of the present invention is that a system is provided that minimizes the long-term growth of the furnace by maintaining the pressures on the hearth bricks as they cool down and shrink, thus preventing seepage of molten material into to the interstitial joints after every cycle.

Another advantage of the present invention is that a system is provided that reduces the rate of expansion of the furnace hearth by increasing the load on the furnace hearth.

A further advantage of the present invention is conventional containment shells can be modified so the thrust blocks and rods of the present invention can be readily installed and put to work.

A still further advantage of the present invention is that a system is provided such that a hearth binding system could also be installed on rectangular furnaces with rigid binding systems, which do not already incorporate tie-rods and springs. The new additions would allow for controlled expansion of the hearth, and thereby reduce the rate of expansion due to the penetration of the hearth that would otherwise occur by molten materials.

Another advantage is embodiments of the present invention allow much longer campaigns before a furnace must be shut down, its hearth brick replaced, and the hearth compression thrust rods reset. When retrofitted with embodiments of the present invention, conventional furnaces with campaign lives of two to four years should be able to double this time before they need to be shutdown for hearth maintenance.

A further advantage of the present invention is that overstressing of the furnace shell caused by hearth refractory expansion can be eliminated.

These and other objects and advantages of the present invention will no doubt become obvious to those of ordinary skill in the art after having read the following detailed description of the preferred embodiments which are illustrated in the various drawing figures.

IN THE DRAWINGS

FIG. 2A shows the use of a load beam, and FIG. 2B shows the use of rocker arms;

Figure 1:
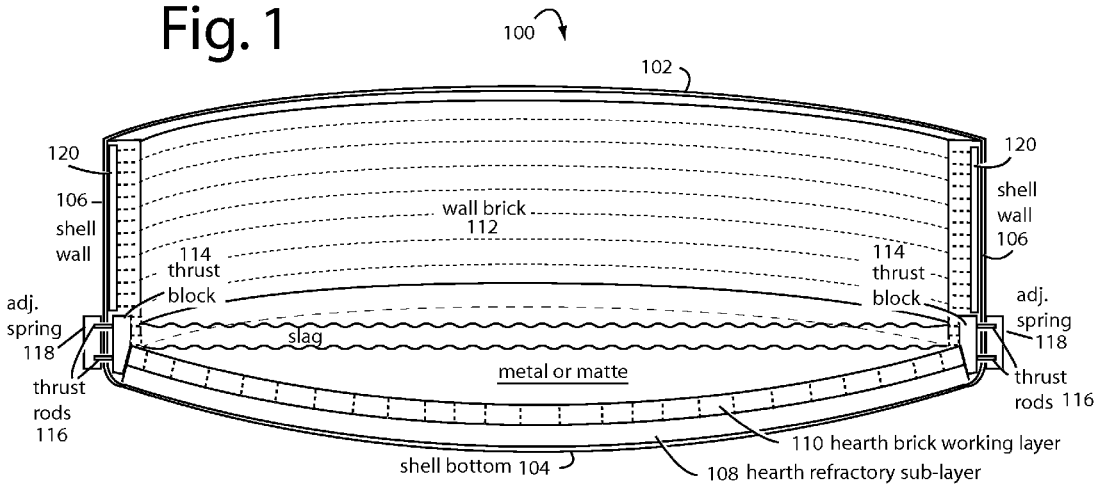
FIG. 1 is a cut-away perspective view diagram of a circular refractory furnace hearth system embodiment of the present invention showing how a perimeter ring of thrust blocks inside the containment shell can be pressed inwardly against the outer edges of the hearth brick working layer using thrust rods and externally mounted adjustable spring sets.
Figure 3:
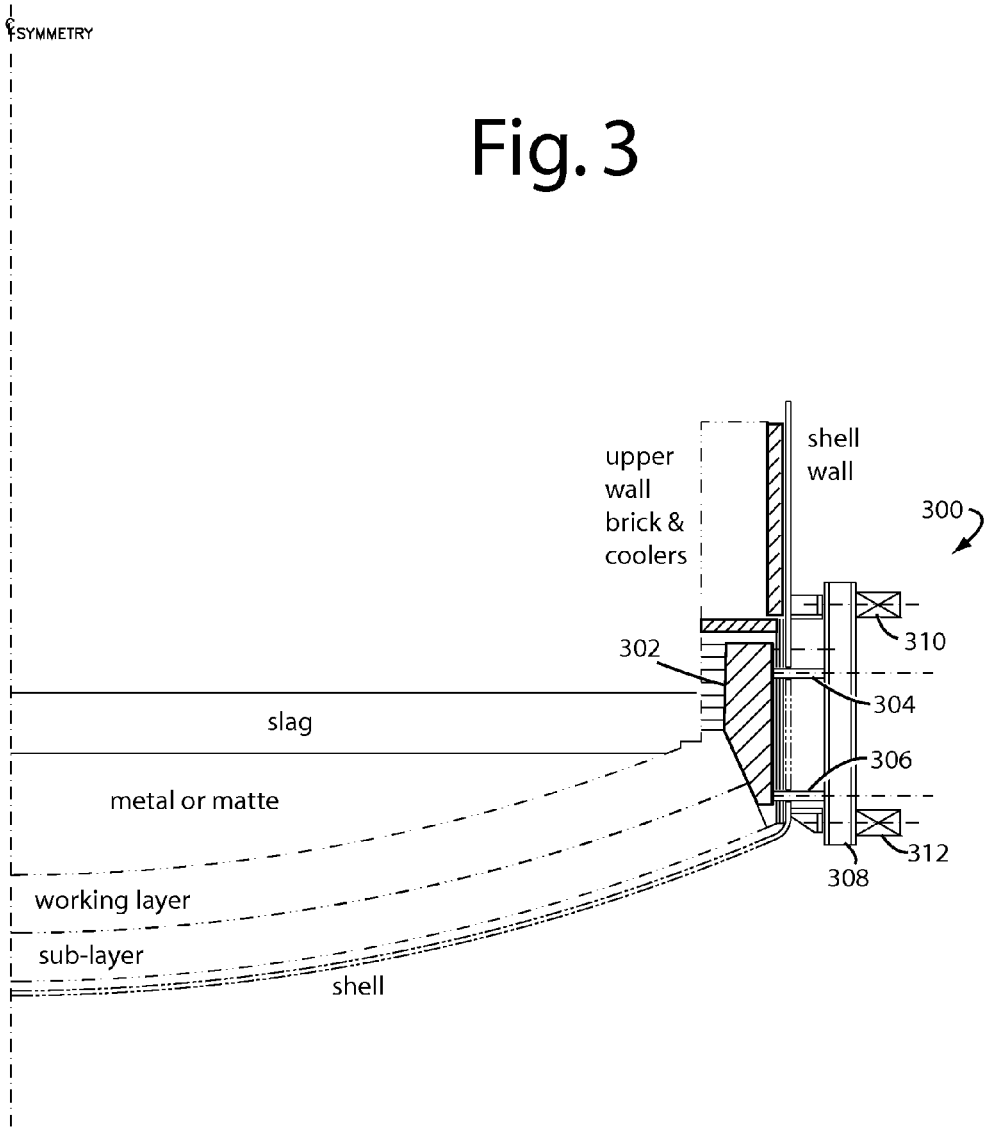
Figure 4:
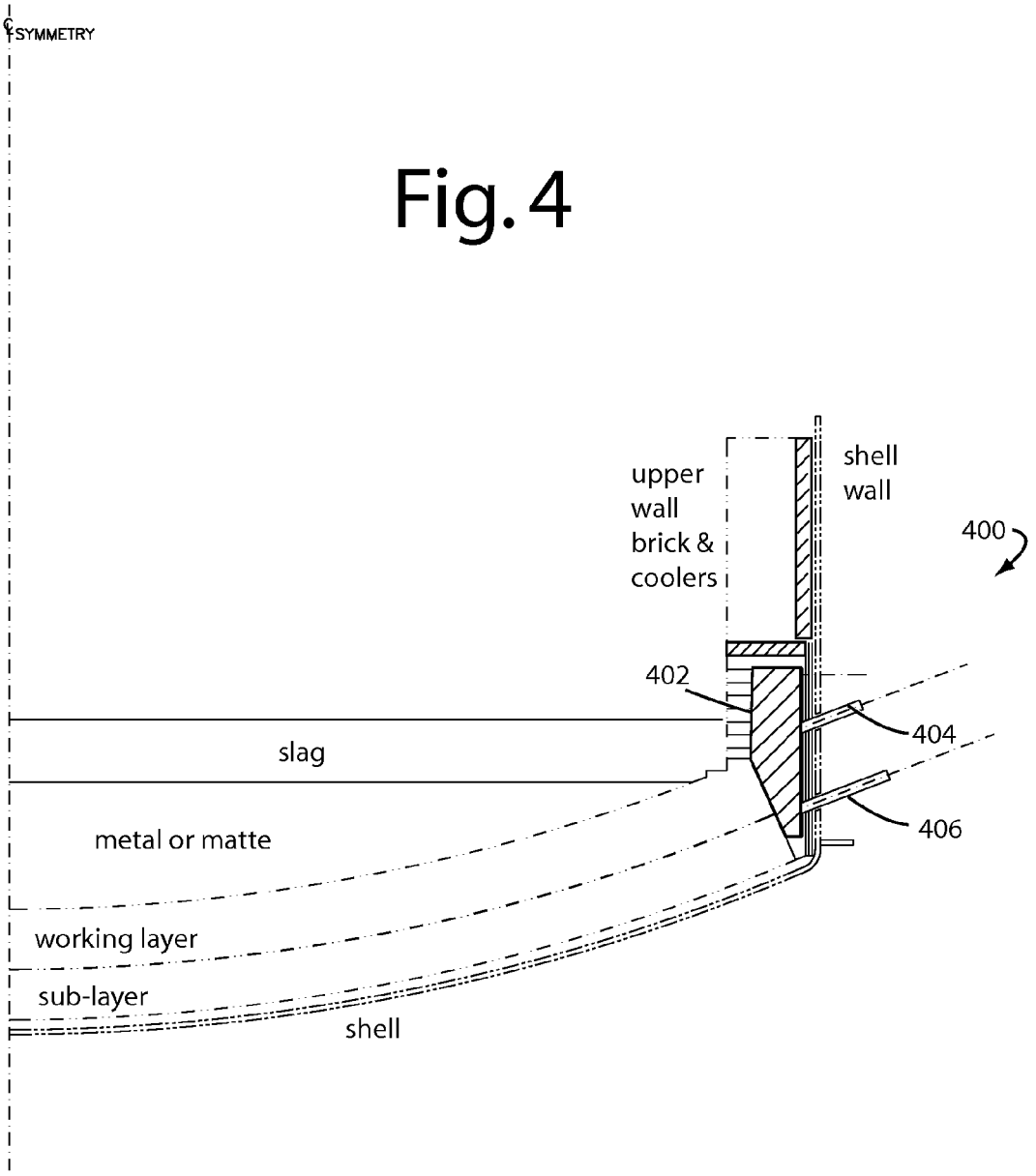
Figure 5A:
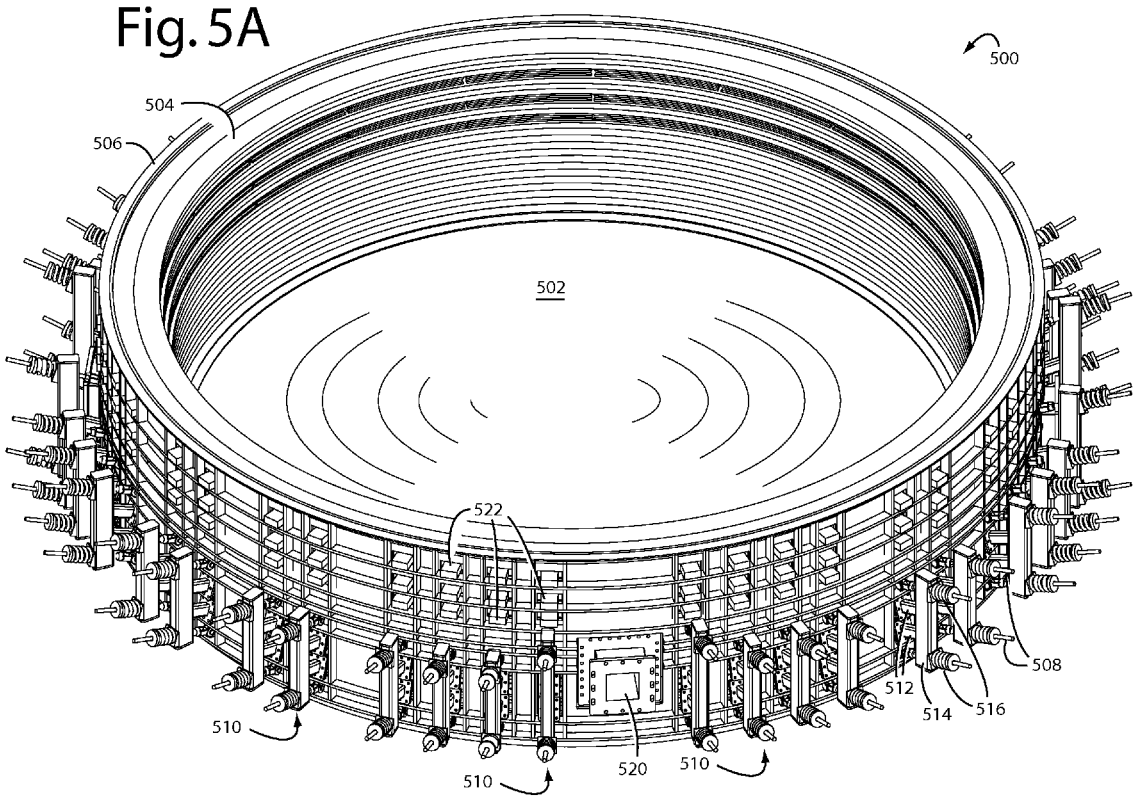
Figure 5B:
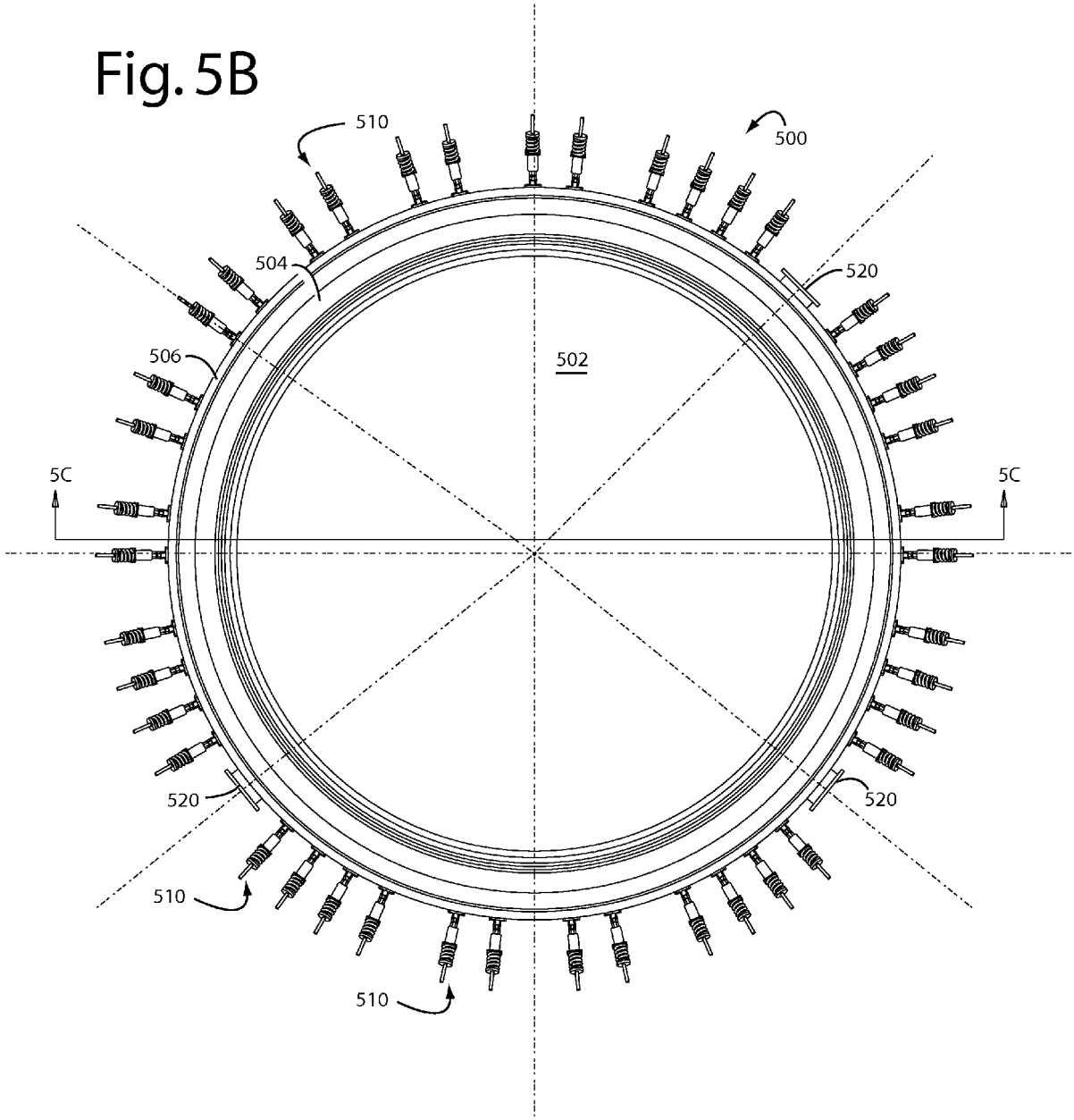
Figure 5C:
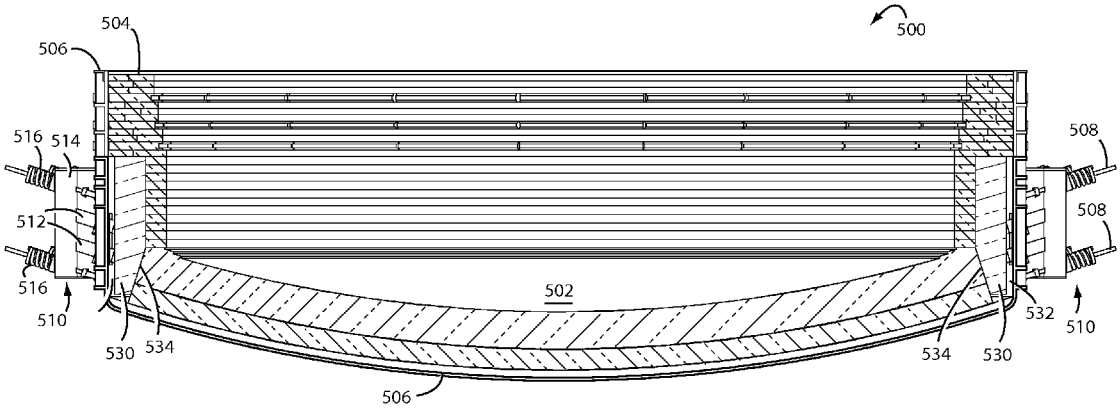
Figure 6:
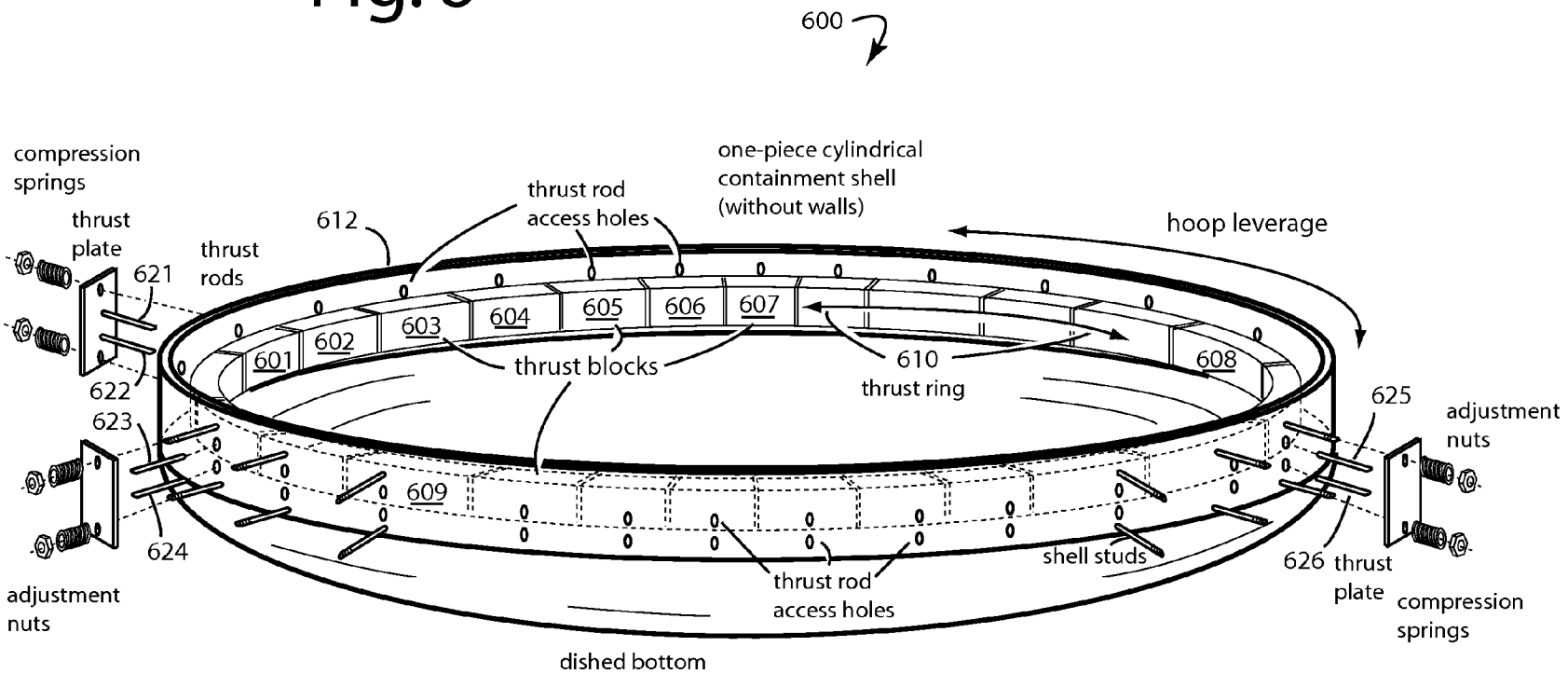

FIG. 3 is a cross sectional view of one thrust block embodiment of the present invention in which cooling is included and the thrust rods press radially inward normal to the axis of a circular furnace hearth; and FIG. 4 is a cross sectional view of another thrust block embodiment of the present invention in which cooling is included and the thrust rods press radially inward inline with the hearth brick working layer at the bottom of a circular furnace hearth;

FIGS. 5A, 5B, and 5C are perspective, top and cross-sectional view diagrams of a furnace embodiment of the present invention like that of FIG. 1, and incorporating elements like those in FIGS. 2A, 2B, 3, and 4; and FIG. 6 is a simplified half section and perspective cutaway diagram of a furnace embodiment of the present invention like that of FIGS. 1, 5A, 5B, and 5C, and incorporating elements like those in FIGS. 2A, 2B, 3, and 4.

While the invention is amenable to various modifications and alternative forms, specifics thereof have been shown by way of example in the drawings and will be described in detail. It should be understood, however, that the intention is not to limit the invention to the particular embodiments described. On the contrary, the intention is to cover all modifications, equivalents, and alternatives falling within the spirit and scope of the invention as defined by the appended claims.

DETAILED DESCRIPTION OF THE PREFERRED EMBODIMENT

FIG. 1 represents a furnace refractory brick hearth system embodiment of the present invention, and is referred to herein by the general reference numeral 100. The system 100 comprises an outer, rigid steel containment shell 102 having a dished bottom 104 and circular vertical walls 106. The bottom is lined with hearth refractory in one or more sub-layers like sub-layer 108, over which is placed a hearth brick working layer 110. Such hearth refractory may comprise individual bricks.

The outer perimeter of the hearth brick working layer 110 supports a wall brick 112. Gravity keeps the wall brick 112 tightly packed, and a ring of thrust blocks 114 inwardly compress and compact the hearth brick working layer 110. The radial compression towards the center is provided by many individual thrust rods 116 that each push inwardly against corresponding thrust blocks 114. The thrust rod forces are provided externally by adjustable spring assemblies 118 mounted on the outside of the shell wall 106. Simple holes, or pushrod guides may be provided for the thrust rods in the containment shell 102. The adjustable spring assemblies 118 take advantage of the hoop strength and solid construction of the shell wall 106 to generate the necessary leverage.

In operation, the adjustable spring assemblies 118 are periodically set to a predetermined pressure value. The hearth brick working layer 110 will inevitably grow in diameter as molecules of molten metal are absorbed into the refractory brick material and the minute spaces between them. Such growth necessitates routine readjustment of the adjustable spring assemblies 118, and so the conditions should be monitored.

Initially, a relatively wide margin of space is provided between the outer edges of the thrust blocks 114 and the inside of shell wall 106. Such can be filled with expansion boards or other crushable material that can be replaced or removed as the space diminishes. Fill material such as this is not required if a spring system embodiment of the present invention is sized to carry the full hearth load.

In some embodiments of the present invention, the thrust blocks 114 are provided with circulating coolant to draw off heat, and may be made of copper or copper alloy. A wall cooler 120 may also be provided which has horizontally or vertically oriented layers. The thrust block 114 is intended to either replace the brick skew, or apply load directly to it. The thrust blocks, as shown in FIGS. 1, 3 and 4, rise from the brick skew to the top of the molten bath.

Alternatively, it could be kept shorter to the top of the brick skews, e.g., to keep only the brick within the hearth working layer tight. The possibility of leaks developing between wall brick and the skews would thereby be eliminated. The shapes of the thrust blocks shown in FIGS. 1-4 are merely exemplary, and should not be understood as limiting the range of useful variations.

The typical commercial furnace hearth size ranges from two to fifteen meters in diameter. The radial spacing of the hearth compression thrust rods 116 depends on the forces required, the stiffness of the inside thrust blocks 114, and should be arranged to avoid interference with tap holes and other openings. As an example, the spacing could be expected to range from one to two meters for larger diameter furnaces, or they could be arranged at 10-30 degree increments around the furnace shell 102.

Thrust rods 116 would generally be fabricated from steel, but may need to be made from metals that can resist corrosion and/or assist in cooling. The size and cross sectional shapes needed for the thrust rods 116 depend on the engineered forces required. Other contributing forces increase with the size of the hearth refractory, as well as the fluid pressure coming from the top of the hearth. The maximum fluid pressures will be observed at the hearth invert, or the lowest point of the hearth.

The devices could be used to impart initial compression of the hearth, which could result in an initial net shrinkage. The devices could be designed to typically accommodate 50-150 mm of hearth expansion. On a percentage basis, up to practical maximum of two percent of the hearth diameter. For larger hearth movements, differential expansion between the wall and the hearth becomes unmanageable, and the required size of the compression rods becomes unreasonable.

The minimum compression forces on the hearth refractory brick must be sufficient to keep interfacial pressures between the bricks greater than the fluid pressures trying to come between or float the bricks. One object is to limit penetration of molten metal, matte or slag that gets into the joints. Too rapid a penetration can induce a quicker than normal rate of expansion of the hearth over the long term. Too much molten metal penetration that gets under the bricks can cause individual bricks and sections of brick hearth to try to separate and float to the top of the matte. So, the hearth compression forces applied must be sufficient to maintain hearth stability, and overcome large buoyancy pressures if molten metals nevertheless get beneath the hearth brick working layer 110.

When embodiments of the present invention supply sufficient hearth compression to maintain hearth stability, and apply the minimum compression needed to limit melt penetration between the joints, their long-term hearth refractory rate-of-growth will not exceed that observed in conventional current hearth designs. And the service life will be greatly increased at very modest cost.

The rate of hearth expansion has been shown to be reduced with good hearth compression. Hence, increasing hearth compression could be used to reduce long-term hearth expansion. With existing hearth designs that use expansion boards between the skews and vertical shell plates, hearth expansion can be 2-50 millimeters (mm) after a furnace has been shut down cold and restarted. In usual practice, the expansion material must be replaced prior to the shell becoming overstressed.

Corrosion can be an issue in those environments where corrosive gases are produced as part of the smelting process. Gases like $SO_2$ and SO, can readily form acids. Acid environments necessitate the use of stainless steel or nickel alloys to resist corrosion.

Parts that may be exposed to high heat loads or molten materials may require cooling. If a component is to be cooled, it may be fabricated from a conductive alloy of copper or other metal, to minimize stresses and to reduce the potential for cracking. For example, the internal member used for distributing the compressive forces to the hearth may be cooled with air, water or other heat transfer fluid or gas; it may have internal cooling passages for conveying the heat transfer fluid or gas.

Figure 2A:
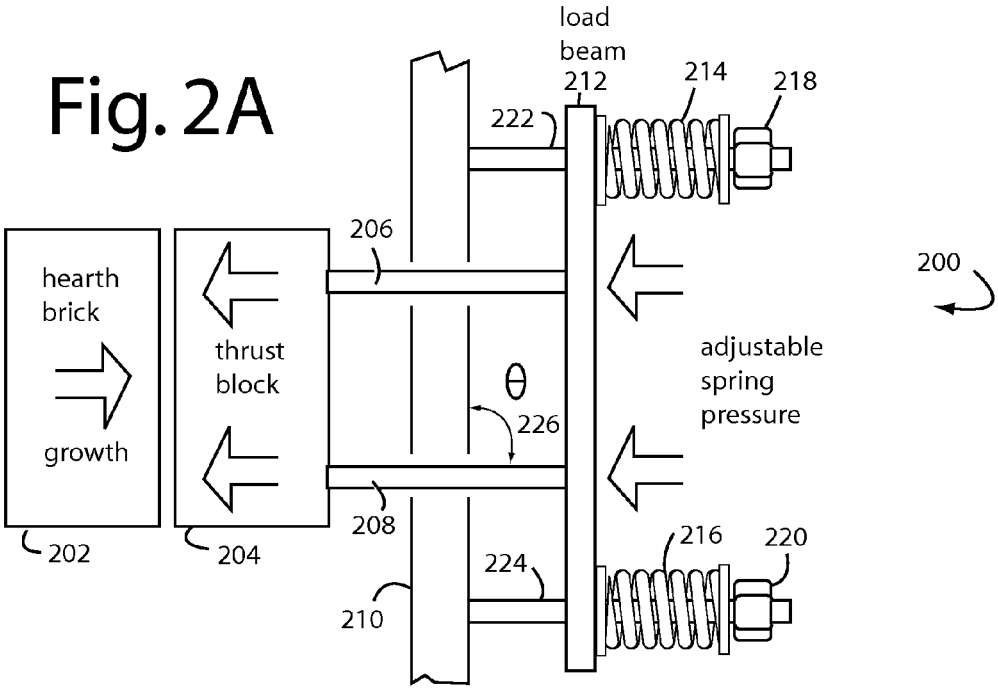
FIGS. 2A and 2B are diagrams showing how spring pressure can be coupled from the outside of the containment shell through to the inside using thrust rods that push in against the ring of thrust blocks around the hearth brick working layer.
Figure 2B:
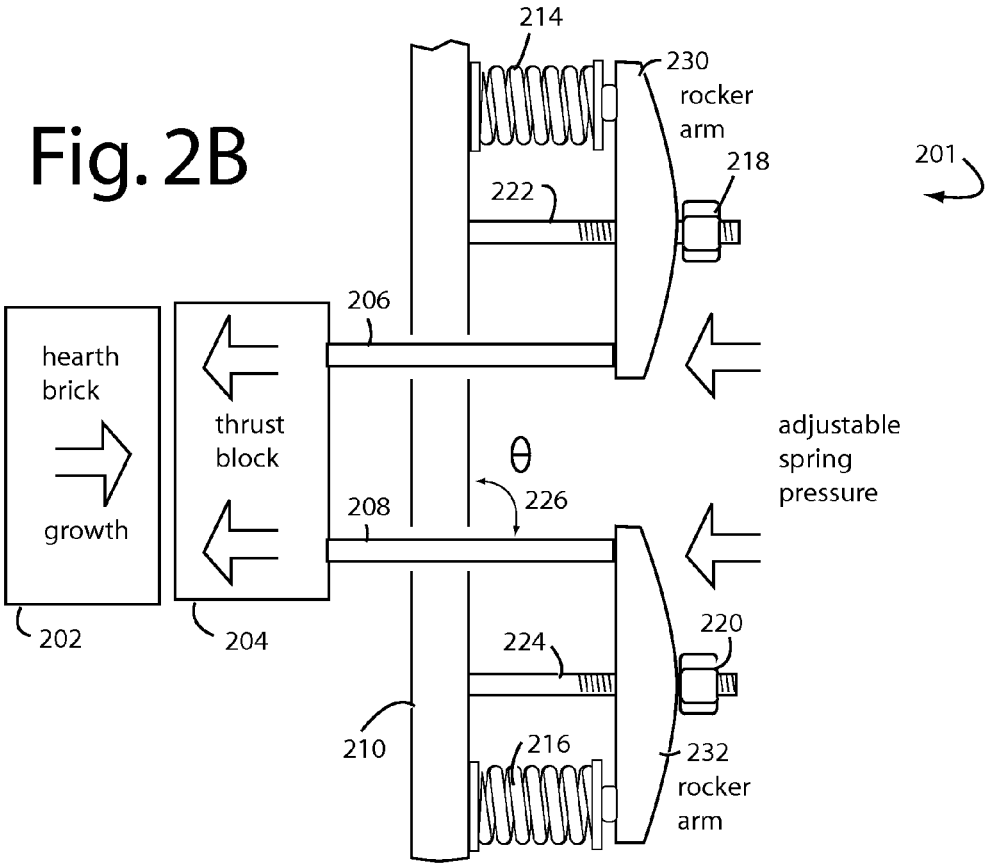

FIGS. 2A and 2B show two slightly different configurations 200 and 201 to couple spring pressure from the outside of the containment shell through to the inside using thrust rods that push in against the ring of thrust blocks around the hearth brick working layer. In FIG. 2A, configuration 200 makes use of a load beam, and in FIG. 2B, configuration 201 uses rocker arms.

In both FIGS. 2A and 2B, a hearth brick working layer 202 grows and presses outwardly against a ring of thrust blocks 204. A number of thrust rods 206 and 208 pass through the outer wall of a containment shell 210 and will transmit inwardly directed pressures.

In FIG. 2A, a load beam 212 bridges over the ends of thrust rods 206 and 208 and presses against them using springs 214 and 216, and adjustment nuts 218 and 220, mounted on external studs 222 and 224.

The inward forces generated by the springs 214 and 216 are directed at an angle theta (θ) 226, e.g., 90-degrees to the central vertical axis of the furnace, or at some appropriate obtuse or acute angle relative to the shell wall 210 to put them inline with the outer edges of a dished bottom hearth brick working layer.

FIG. 2B shows the use of a pair of rocker arms 230 and 232. The studs 222 and 224 allow adjusting nuts 218 and 220 to act as fulcrums.

Adjusting nuts 218 and 220 are set at the beginning, and then reset during the service life of hearth brick working layer 202 as it grows. The amount of pressure applied by particular springs can be interpreted from compression charts according to their present compressed spring length. Other mechanisms could also be used to estimate thrust rod pressures to keep the furnace in proper tune.

FIG. 3 shows a horizontal-type thrust block system embodiment of the present invention, and is referred to herein by the general reference numeral 300. A copper-alloy thrust block 302 has internal water jackets to circulate a coolant and a tapered edge to press square against a hearth brick working layer. A pair of thrust rods 304 and 306 are pressed radially inward normal to the vertical axis of a circular furnace hearth by a spreader beam 308. Adjustments to the thrust rod forces can be made by a pair of tie-rod and spring sets 310 and 312.

FIG. 4 shows an angled-type thrust block system embodiment of the present invention, and is referred to herein by the general reference numeral 400. A copper-alloy thrust block 402 has internal water jackets to circulate a coolant and a tapered edge to press square against a hearth brick working layer. A pair of thrust rods 404 and 406 are pressed radially inward inline with the outer edges of a hearth brick working layer. Alternatively, thrust rod 404 or 406 could be horizontal while the other is inclined. The spring assemblies with rocker arms and/or spreader beams, as shown in FIGS. 2A, 2B, and 3, for example could be adapted for use.

Seals can be included around each thrust rod where it penetrates the furnace shell to control leakage. But, if the spring system is doing its job keeping the bricks tight, such seals would not be necessary.

The refractory bricks inside a furnace are quite brittle. Uneven pressures on the bricks can allow uneven thermal expansion and possible break outs of molten material from the furnace.

Embodiments of the present invention use a circular band portion of the vertical walls of the containment shell for evenly applied inward radial leverage like a barrel hoop. In this way, the shell maintains hoop tension and naturally resists distortions. Dozens of radial thrust rods are used to uniformly compress a ring of thrust blocks and the refractory brick they encircle inside the furnace.

Heat transmission through the brick is improved by uniform compression of the refractory. The campaign life of the brick and the furnace is extended, because the rings of brick expand outward, increasing the pressures between the shell and the bricks.

In conventional rectangular furnaces, the bricks tend to pull away from the walls and coolers during each campaign because the bricks swell more on the hot faces than they do on the cooler backsides. The trapezoiding produces gaps between the lower edges of the brick, resulting in rapid erosion and chemical corrosion of the bricks. Such is well known to designers of circular and rectangular furnaces.

A hearth shell plate bolted to a vertical shell plate is considered "one piece". The shell at the level of the compression devices should be one piece. However, if openings are needed, they must be reinforced to maintain overall integrity of the shell.

FIGS. 5A, 5B, and 5C represent a furnace embodiment of the present invention, and is referred to herein by the general reference numeral 500. Furnace 500 has a bottom refractory layer 502 in a downwardly dished circular bottom, and a circular, vertical wall 504 of refractory brick inside a single-piece, vertical cylindrical containment shell 506. A number of threaded studs 508 are fastened at intervals in two parallel planes around the outside of the containment shell 506. These secure and provide leverage for dozens of compression assemblies 510 that work through compression rods 512 to keep the bottom refractory layer 502 tightly packed and free of gaps.

A thrust bar 514 in each compression assembly 510 is able to slide in and out on vertical pairs of threaded radial studs 508. Pairs of thrust springs 516 push the thrust bars 514 and thrust rods 512 radially inward against bottom refractory layer 502 using threaded radial studs 508 for leverage. Nuts (not shown) on the ends of the threaded radial studs 508 keep the springs 516 and allow some adjustment. Other spring arrangements are possible.

As the bottom refractory layer 502 grows in diameter during its campaign life, springs 516 will compress but still maintain more-or-less even pressure all around the circular perimeter of bottom refractory layer 502.

A tap hole 520 is water cooled and allows molten material to be tapped out, according to the elevation of its placement. Different elevations provide for the tapping of slag (molten oxides solution floating on top), matte (molten metal sulfide phases), or molten metal (the heaviest and at the bottom). The ends 522 of water cooled copper blocks can be seen all around the outside of furnace 500 in FIG. 5A.

As can be seen clearly in FIG. 5C, the threaded studs radial studs 508 in compression assembles 510 are tilted upwards at their ends to more closely align with the plane of bottom refractory layer 502 at its outer edges. This configuration is also represented in FIG. 4. Thrust ring 402 in FIG. 4 is the equivalent of a ring of thrust blocks 530 in FIG. 5C. The ring nature of this feature is shown more plainly in the simplification of FIG. 6. A gap 532 outside the ring of thrust blocks 530 and inside the containment shell 506 provides room for the eventual expansion of the bottom refractory layer 502 over the campaign life.

Each thrust block 530 has a face 534 configured to be perpendicular to the plane of the bottom refractory layer 502 at its circular outer edges. FIGS. 5A, 5B, and 5C show the bottom refractory layer 502 in the shape of a spherical cap. In some applications, the bottom refractory layer 502 may be in the form of a flat, round or circular disk.

FIG. 6 represents a system 600 for applying and maintaining proper compression of brick hearth in a furnace refractory so as to extend its service life. System 600 comprises a plurality of thrust blocks, e.g., 601-609, arranged in a thrust ring 610 with an inner face 612 for contacting an outer perimeter of a bedding of hearth brick. The thrust ring 610 is disposed in the bottom of a vertical cylindrical pyrometallergical furnace, e.g., inside a one-piece, non-segmented steel containment shell 612. A plurality of thrust rods, e.g., 621-626, penetrate the containment shell and transmit inwardly radial compression forces to matching outer faces of corresponding ones of the plurality of thrust blocks 601-609.

Although the present invention has been described in terms of the presently preferred embodiments, it is to be understood that the disclosure is not to be interpreted as limiting. Various alterations and modifications will no doubt become apparent to those skilled in the art after having read the above disclosure. Accordingly, it is intended that the appended claims be interpreted as covering all alterations and modifications as fall within the "true" spirit and scope of the invention.

What is claimed is:

1. A device for applying and maintaining compression of hearth brick in a furnace refractory so as to extend its campaign life, comprising:

a plurality of thrust blocks with an inner face for contacting an outer circular perimeter of a bedding of hearth brick disposed in the dished bottom of a vertical cylindrical pyrometallergical furnace, and inside a non-segmented steel containment shell;

a plurality of thrust rods that penetrate said containment shell and that provide for the transmission of an inwardly radial compression force to matching outer faces of corresponding ones of the plurality of thrust blocks;

at least one of a plurality of load beams and a plurality of rocker arms in contact with corresponding ones of the plurality of thrust rods outside said containment shell;

a plurality of springs arranged outside said non-segmented containment shell and each having a compressive contact with corresponding ones of the plurality of load beams or the plurality of rocker arms such that individual spring pressures are combined and directed as an inwardly radial compression force to matching outer faces of corresponding ones of the plurality of thrust blocks;

wherein, the whole is arranged in a horizontal ring around the bottom of said containment shell adjacent to the outside circular perimeter of said bedding of hearth brick, and further comprising a solid shell wall with a hoop strength for leverage.

2. The device of claim 1, further comprising:

a plurality of adjustable studs for attachment to said containment shell, corresponding ones of the plurality of springs, and corresponding ones of the plurality of load beams and plurality of rocker arms, and providing for an adjustment of said inwardly radial compression force directed to matching outer faces of corresponding ones of the plurality of thrust blocks.

3. The device of claim 1, wherein each of the plurality of thrust blocks has an inner face angled to squarely contact said outer perimeter of a bedding of hearth brick.

4. The device of claim 1, wherein each of the plurality of thrust rods penetrates said containment shell at an angle dependent on said inner face angle.

5. A furnace refractory brick compression system, comprising:

a plurality of thrust blocks configured to be arranged in a circular ring around outer edges of a dished bottom hearth brick working layer;

a plurality of studs for fastening along an outside circular ribbon at intervals to a single-piece vertical cylindrical containment shell in the bottom of which are disposed said outer edges of a dished bottom hearth brick working layer;

a plurality of push rods for penetrating said single-piece vertical cylindrical containment shell along said outside circular ribbon at intervals corresponding to said individual ones of the plurality of studs; and a plurality of springs for applying an inwardly radial compressive force on respective ones of the plurality of thrust blocks via the plurality of push rods, and that work against the plurality of studs for leverage;

wherein, said outer edges of a dished bottom hearth brick working layer can thereby be held tightly together during their campaign life as they swell, and further comprising a solid shell wall with a hoop strength for leverage.

6. A method of extending the campaign life of hearth brick in a furnace refractory, comprising:

placing a plurality of thrust blocks with an inner face in contact with an outer perimeter of a bedding of hearth brick disposed in the bottom of a vertical cylindrical pyrometallergical furnace, and inside a non-segmented steel containment shell;

using a plurality of thrust rods to penetrate said containment shell and to provide for the transmission of an inwardly radial compression force to matching outer faces of corresponding ones of the plurality of thrust blocks;

installing at least one of a plurality of load beams and a plurality of rocker arms in contact with corresponding ones of the plurality of thrust rods outside said containment shell; and arranging a plurality of springs outside said containment shell with each having a compressive contact with corresponding ones of the plurality of load beams or the plurality of rocker arms such that individual spring pressures are combined and directed as an inwardly radial compression force to matching outer faces of corresponding ones of the plurality of thrust blocks;

wherein, the whole is arranged in a horizontal ring around the bottom of said containment shell adjacent to the outside perimeter of said bedding of hearth brick, and further comprising a solid shell wall with a hoop strength for leverage.

7. The method of claim 6, further comprising:

attaching a plurality of adjustable studs to said containment shell, corresponding to ones of the plurality of springs, and corresponding to ones of the plurality of load beams and plurality of rocker arms, and providing for an adjustment of said inwardly radial compression force directed to matching outer faces of corresponding ones of the plurality of thrust blocks.

8. The method of claim 6, further comprising:

angling an inner face of thrust blocks to squarely contact said outer perimeter of a bedding of hearth brick. of the plurality of thrust rods penetrates said containment shell at an angle dependent on said inner face angle.

9. The method of claim 6, wherein each of the plurality of thrust rods penetrates said containment shell at an angle dependent on said inner face angle.

* * * * *